United States Patent [19]

Salmon

[11] Patent Number: 4,593,793

[45] Date of Patent: Jun. 10, 1986

[54] ELEVATOR DOOR CONFIGURATION

[75] Inventor: John K. Salmon, South Windsor, Conn.

[73] Assignee: Otis Elevator Company, Farmington, Conn.

[21] Appl. No.: 568,958

[22] Filed: Jan. 6, 1984

[51] Int. Cl.[4] ..... B66B 13/00

[52] U.S. Cl. ..... 187/56; 49/352

[58] Field of Search ..... 187/56, 52 R, 51, 1 R, 187/8.59, 58, 60; 49/352, 326, 327, 360, 324; 160/25, 23, 279, 322

[56] References Cited

U.S. PATENT DOCUMENTS

| | | | |
|---|---|---|---|
| 1,710,442 | 4/1929 | Warshaw | 187/8.59 |
| 2,978,019 | 4/1961 | Carlo | 160/23 R |
| 3,405,782 | 10/1968 | Berkovitz et al. | 187/58 |
| 3,426,480 | 2/1969 | Dzamba | 187/56 |
| 4,001,971 | 1/1977 | Gobush et al. | 49/352 |

*Primary Examiner*—Joseph J. Rolla
*Assistant Examiner*—Kenneth Noland

[57] ABSTRACT

The directional stability of a horizontally-moved door is maintained by cables that are directed around rollers which are concealed in the door; the cables are concealed in the door by one or more tracks that extend in the direction in which the door is propelled; and rollers that are on the door follow one of the tracks to guide the door and support its weight.

4 Claims, 4 Drawing Figures

ELEVATOR DOOR CONFIGURATION

DESCRIPTION

1. Technical Field

This invention concerns sliding doors, especially those which are large and heavy, as found in elevators.

2. Background Art

Smooth door control and operation can be difficult to obtain in some elevator systems, especially those where the doors are large and heavy and have a high aspect ratio, that is, the height is very large compared to the width. In a typical double-door system, in which there are side or center opening doors, doors are mechanically connected, and one of the doors is opened by a door controller or drive that is typically connected to the top of one of the doors. This creates a tendency for uneven weight distribution on the door support rollers, which in the typical elevator system are located near the top of the car, where they ride on a track. These doors are "hung". As a result of uneven distribution, as when the doors move, then one or both of them may tilt slightly, creating, in some instances, uneven door operation, that is, jittery motion, binding, and noise. These problems are particularly vexing if the doors are heavy and have a high aspect ratio, because the moment around the guide rollers, whether they be hung or not, may be significant, increasing the chances of uneven door motion.

In addition, when external horizontal forces are applied to a door in its plane of travel at other than its point of resistance to motion, twisting moments are developed. With support rollers close to one another, it is difficult to limit door rocking reliably and continually as wear occurs in normal use. This effect becomes progressively more significant as aspect ratio increases.

DISCLOSURE OF INVENTION

A prime object of the present invention is providing an elevator door configuration in which the weight of the door is always evenly distributed on the guide rollers, whether they be on the top or the bottom of the car, and in which those factors that can cause uneven door motion are minimized.

According to the present invention, the lower sections of a large door are connected to upper support cables (or belts or chains) that hold the door in a proper position throughout its travel by applying counteracting forces around the center of the door.

According to one aspect of the invention, the top and bottom of the elevator car door are connected to a fixed surface, such as the car frame or the landing, by cables that extend over rollers that are located on the top and bottom of the door. These rollers are grooved to accept the cable and may be concealed within the door and a track located near the top and bottom of the car. In the latter application, the cable passes to and from the rollers within a recess in the track, thus concealing the cable from the naked eye.

According to another aspect of the present invention, the cable-connected rollers may also be used to support the door. They may, for example, be located on the top of the door and connected to a track to create a guided door arrangement, as is found in the prior art, the only exception being that the cable arrangement associated with the rollers would hold the door in a true or a near perpendicular position throughout its travel, which minimizes the rolling friction of the door, even on the horizontal rail.

A more particularly attractive feature of the invention is that the rollers located on the bottom of the door that are used for riding the cables may also be used to support the door, and the cables that pass to and from these rollers may be concealed in a slotted or channeled-shape track, which provides guidance for the rollers, thereby also the door, and which act to conceal the cable throughout the range over which the door moves. In addition, the cables also provide door side guidances, which normally (in prior systems) is provided by guides or small rollers that are prone, due to their small size, to rapid wear and noisy operation.

Another attractive feature of the invention is that the cables that pass around the rollers and which provide directional support to the door so that the door remains true or perpendicular throughout its travel may be enclosed within the interior of the door, thereby concealing them from occupants in an elevator car or similar structure. Thus, the cables are not visible at any position, being concealed within the elevator door and within the track or tracks that are used in association with the rollers.

Another aspect of the invention is that a single or plural rollers may simply be used at a lower portion of the door to ride in the track, and in that application of the invention the rollers on the lower portion of the door simply act to guide the cables as they pass through the door, the cables being concealed within the track.

A feature of the present invention is that a resultant elevator door motion is extremely smooth throughout the door's travel range, yet the cables are unnoticeable to users and do not present an obstruction in any way.

Another feature is that the need to hang the doors and depend on upthrust tracks, as in typical elevator systems, to avoid the problems associated with the uneven driving force derived from an elevator door drive that is located in the upper portions of the car is eliminated.

The invention has particular application in an elevator system, where the doors are heavy and typically of high aspect ratio. The invention may, however, have application in other systems where similar problems are encountered.

BEST MODE FOR CARRYING OUT THE INVENTION

Figure 3:
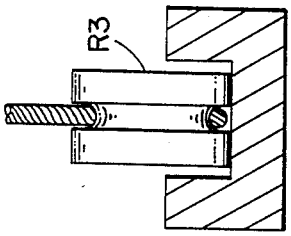
FIG. 3 is an elevational view of one of the rollers around which a cable is directed in a door arrangement according to the present invention.
Figure 1:
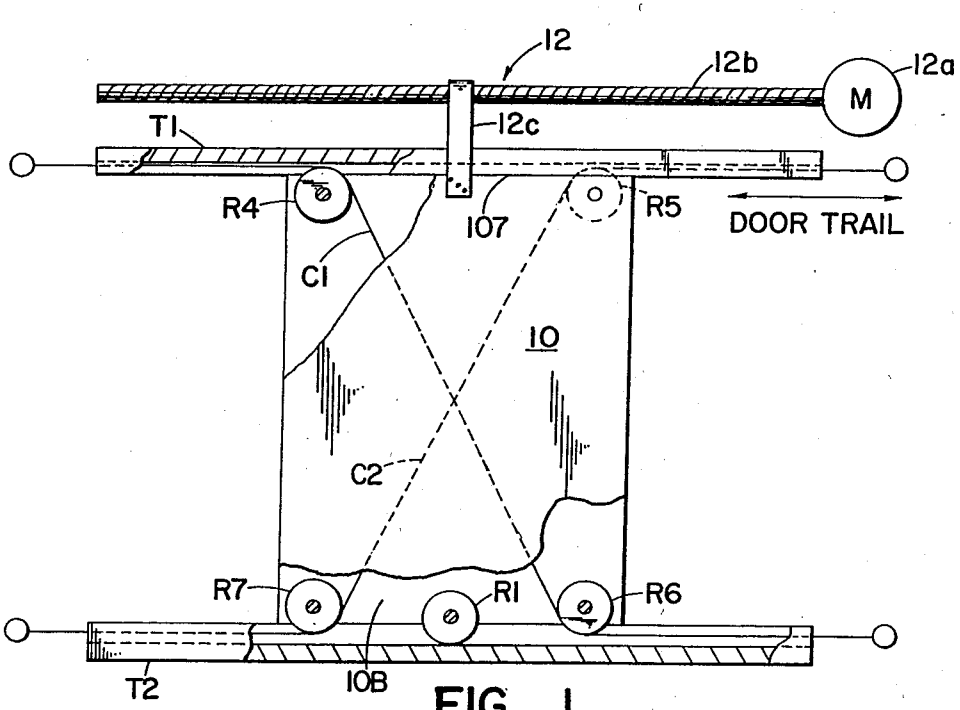
FIG. 1 is an elevational view, partially cut away, of an elevator door and door closure system embodying the present invention and in which a portion of the door is cut away to expose the rollers and cables therein.
Figure 2:
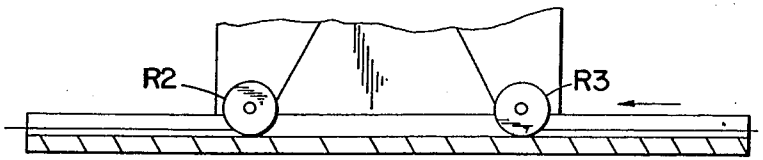
FIG. 2 is a partial elevational view of an elevator door embodying a second version of the invention.

Referring to FIG. 1, it shows one door 10, which may be part of a double-door elevator system, that is connected to a drive 12 which consists of an electric motor **12*a*, a lead screw 12*b*, which is rotated by the motor, and a lead screw follower 12*c* which is attached at the upper edge of the door at a position which may be characterized as a position substantially not at the door's mass center (MC). This location of the follower creates a turning moment around the MC that tends to cause the door to tip as the follower accelerates, which causes uneven weight distribution which produces uneven door motion. In the door arrangement that is shown in FIG. 1, there is additional apparatus that maintains the door at a near perpendicular position throughout its travel ("door travel"). In this particular configuration in FIG. 1, the door is supported on two rollers R2,R3, as shown in FIG. 2. There are, in FIG. 1, two cables C1,C2, whose ends are fixed (attached) relative to the doors. These cables pass inside two guide tracks T1,T2, that are positioned just adjacent the top 10T and bottom 10B of the door. The cables are thus concealed within the tracks, which may be "U-shaped" (see FIG. 3). The lower track receives the single-supporting roller R1 which rides on the bottom of the U-shaped portion of the track. There are four rollers on the door (in addition to roller R1), R4,R5,R6,R7. Each cable passes diagonally across the door and around diagonal rollers, forming an X-pattern which results in a door support that holds the door in a vertical position due to the pull of the cables on the door edges (through the rollers). The cables are concealed within the track, as noted; to be more precise, they are concealed within the track throughout the range of travel of the door. The lower rollers may be concealed in the lower track by placing the bottom of the door close to the track, that being the configuration that is shown in FIG. 1**.

Some apparatus that is conventionally known in the prior art has been excluded from FIG. 1. There may be a hanger track along the upper edge of the door to support the door edge surface. But, as an alternative, this guidance may be provided by the upper track (which conceals the cables and upper rollers) if the upper rollers are firmly positioned in the interior of the track. The roller, in this configuration, will be rolling within the U-shaped channel to provide vertical guidance for the upper edge of the door, like the guidance provided by a hanger configuration. The door will still have its load carried on a single roller that rides on the lower channel or track, although FIG. 2 shows a variation of that.

In FIG. 2 the two lower rollers on the door which route the cables are also used to support the door by resting on the lower surface of the channel.

In the embodiment shown in FIG. 1, the single door is cut away to demonstrate that the cables may be concealed within the interior of the door. The cables thus are not visible at any point along the door's travel to an occupant or an observer, being concealed within the track and within the door.

Figure 4:
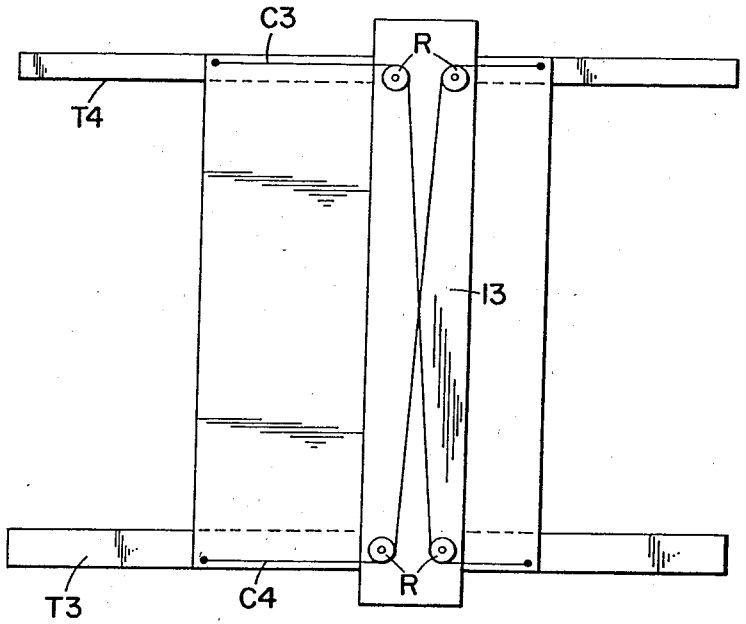
FIG. 4 shows an alternative embodiment of the invention, less the door guide rollers.

An alternative, but somewhat less attractive variation comprises reversing the arrangement in FIG. 1, and this is shown in FIG. 4. The ends of the cables C3,C4 may be anchored to the door, and the four rollers, rather than being anchored to the movable door 11, may be anchored to a vertical post 13 on one side of the door. Thus, the cables pass diagonally across the rollers on this fixed diagonal post and their ends are attached to the door at diagonal positions on the door. This arrangement also provides vertical support to the corners of the door, again allowing it to maintain a near perpendicular position throughout its range of travel. The cables are also concealed in the tracks 73,74 in this embodiment.

From the foregoing it can be seen that a particularly attractive feature of the present invention is this: through an extremely simple mechanism it is possible to maintain a very high aspect ratio heavy door in a near perpendicular position relative to its travel. This eliminates most of the tipping or skewing problems that are normally associated with driving such a door from a position off its center of mass, and since that provides even weight distribution on the rolling components, there is less wear on the rollers and smoother operation. Moreover, fewer door support rollers can be employed.

To one skilled in the art, the foregoing description will suggest other variations and alterations to the invention (e.g., using belts or chains rather than cables) that do not depart from the true scope and spirit of the invention that has been described.

I claim:

1. In combination:

a door that is propelled horizontally by a door drive;

a door guidance track that is U-shaped and extends the direction in which the door is propelled along the lower edge of the door for receiving at least one roller that guides the lower edge of the door along the path of the track;

four rollers that are attached to the door at diagonally-opposed positions near the door corners;

a first cable whose ends are fixed relative to the door and which is directed from an attachment point around a first roller and then around a second roller which is diagonally opposite to an attachment point; and a second cable whose ends are fixed relative to the door and which is directed from an attachment point around a third roller and then around a fourth roller to an attachment point;

each cable along the lower edge of the door being positioned within the U-shaped portion of the track throughout the door's range of travel; and said cables are concealed in the interior of said door.

2. A combination according to claim 1, characterized in that there is a second track like said first track which extends said direction of travel by the door and is situated along the top edge of the door, said cables being concealed in the U-shaped portion of said second track throughout the range of travel of said door.

3. A combination according to claim 1, characterized in that there is a second track like said first track which extends said direction of travel by the door and is situated along the top edge of the door, said cables being concealed in the U-shaped portion of said second track throughout the range of travel of said door.

4. In combination:

a door that is propelled horizontally by a door drive system that is connected to the door at a point;

a door guidance track that is U-shaped and extends the direction in which the door is propelled along the lower edge of the door for receiving at least one roller that guides the lower edge of the door along the path of the track;

four rollers that are attached to the door at diagonally-opposed positions near the door corners;

a first cable whose ends are fixed relative to the door and which is directed from an attachment point around a first roller and then around a second roller which is diagonally opposite to an attachment point; and a second cable whose ends are fixed relative to the door and which is directed from an attachment point around a third roller and then around a fourth roller to an attachment point;

each cable along the lower edge of the door being positioned within the U-shaped portion of the track throughout the door's range of travel;

two of said rollers, which are located along the lower edge of the door, being positioned in said U-shaped portion for guiding the door along its range of travel along said track; and said cables are concealed in the interior of said door.

* * * * *

UNITED STATES PATENT AND TRADEMARK OFFICE

CERTIFICATE OF CORRECTION

PATENT NO. : 4,593,793

DATED : June 10, 1986

INVENTOR(S) : John K. Salmon

It is certified that error appears in the above-identified patent and that said Letters Patent is hereby corrected as shown below:

Column 4, line 44, "claim 1" should read --claim 4--.

Column 4, line 44, "3" should read --4--.
line 50, "4" should read --3--.

Signed and Sealed this

Fifteenth Day of June, 1993

Michael K. Kirk

*Attest:*

MICHAEL K. KIRK

*Attesting Officer*

*Acting Commissioner of Patents and Trademarks*